United States Patent [19]

Froutzis

[11] Patent Number: 4,827,565

[45] Date of Patent: May 9, 1989

[54] SLIDING DRAPERY HANGER

[76] Inventor: Andrew Froutzis, 53224 Marina Dr., Elkhart, Ind. 46514

[21] Appl. No.: 90,597

[22] Filed: Aug. 28, 1987

[51] Int. Cl.[4] ..... A47H 13/10

[52] U.S. Cl. ..... 16/87.4 R; 16/930

[58] Field of Search ..... 16/87.4 R, 930

[56] References Cited

U.S. PATENT DOCUMENTS

| | | | |
|---|---|---|---|
| 3,157,907 | 11/1964 | Stall | 16/87.4 R |
| 3,378,879 | 4/1968 | Stall | 16/87.4 R |
| 3,698,034 | 10/1972 | Endou et al. | 16/87.4 R |
| 4,115,899 | 9/1978 | Ford | 16/87.4 R |
| 4,390,055 | 6/1983 | Fenley | 16/87.4 R |
| 4,584,737 | 4/1986 | Ohman | 16/87.4 R |

*Primary Examiner*—M. Jordan

*Attorney, Agent, or Firm*—Thomas J. Dodd

[57] ABSTRACT

A drapery hanger which includes a plurality of individual slide members which are snap fitted in a slidable fashion within a wall or ceiling mounted track. The drape has an elongated tape fixed to its upper margin and includes snap fasteners which mate with the slide members to secure the drape for sliding movement relative to the track.

4 Claims, 1 Drawing Sheet

SLIDING DRAPERY HANGER

SUMMARY OF THE INVENTION

This invention relates to improvements in sliding drapery hangers.

The current state of the art in sliding drapery hangers is disclosed in my U.S. Pat. No. 4,216,564. In that invention, an elongated tape strip was stitched to the upper marginal portion of the drape. The tape strip included a plurality of integral slide fasteners which interlocked in a snap fit manner with a slide track. Due to the permanent nature of the stitchery, it was necessary to remove the slides from the track to clean the draperies which often proved awkward.

The improved drapery hanger of this invention includes individual slide fasteners which snap fit into the slide track. The slide fasteners are in turn snap fitted to the elongated tape which is connected to the top margin of the drape. This double snap fit interlock between drape and slide and track allows for rapid installation of the drape and also allows for rapid removal when cleaning is necessary.

Accordingly, it is an object of this invention to provide for an improved sliding drapery hanger.

Another object of this invention is to provide for a sliding drapery hanger which is easily installed and removed.

Another object of this invention is to provide for a sliding drapery hanger which is economical and durable.

Other objects of this invention will become apparent upon a reading of the following description.

BRIEF DESCRIPTION OF THE DRAWINGS

A preferred embodiment has been depicted for illustrative purposes wherein.

DESCRIPTION OF THE PREFERRED EMBODIMENT

Figure 1:
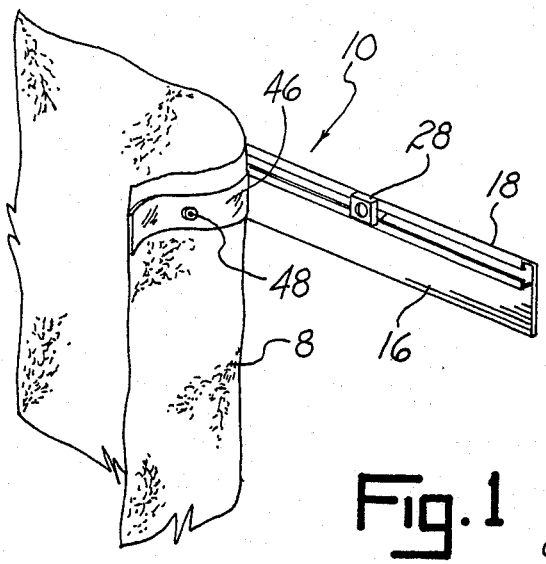
FIG. 1 is a fragmentary perspective of a sliding drape which shows the improved hanger of this invention.
Figure 2:
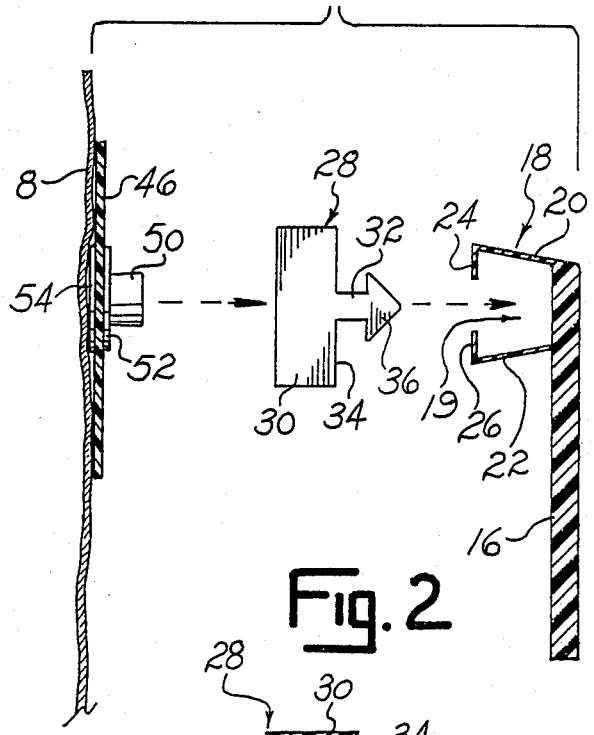
FIG. 2 is an exploded view of the drape and hanger.

The preferred embodiment herein described is not intended to be exhaustive or to limit the invention to the precise form disclosed. It is chosen and described to explain the principles of the invention and its application and practical use to enable others skilled in the art to utilize the invention.

Referring now to the drawings, reference numeral 10 refers to a drapery slide track which is mounted to a side wall or a ceiling (not shown) by appropriate fasteners. Track 10 includes a mounting plate 16 through which fasteners (not shown) extend and an upper integral channel part 18 defined by spaced divergent legs 20, 22 and opposed lips 24, 26 as shown. Track 10 is the same as the track shown in FIG. 3 of my U.S. Pat. No. 4,216,564 which is incorporated herein by reference.

Figure 3:
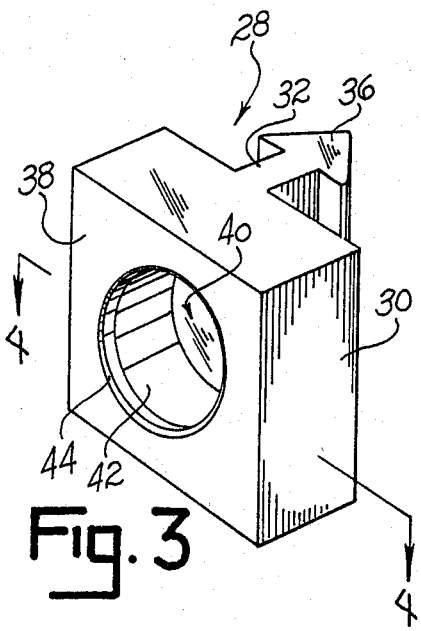
FIG. 3 is a perspective view of an individual slide member.
Figure 4:
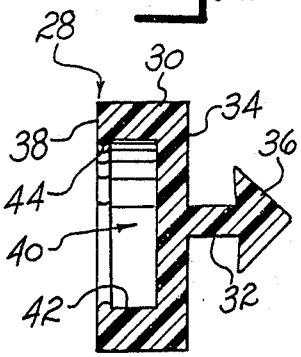
FIG. 4 is a sectional view taken along line 4—4 of FIG. 3.

Reference numeral 28 refers generally to the slide members shown in detail in FIG. 3. Each slide member 28 is preferably formed of a one-piece molded plastic material and includes a base 30 and a flange 32, which projects from surface 34 of the base. A triangular shaped lock member 36 projects from the free end of flange 32 as shown. The opposite surface 38 of base 30 defines a bore 40 which extends partially through base 30 and is defined by wall 42 and an upper lip 44.

Reference numeral 46 generally refers to the elongated tape which is fastened to drape 8 by stitching or other suitable means such as shown in the drawings. Snap fasteners 48 each includes an interlock part 50 defined by diverging walls which mates with bore 40 of a corresponding slide member 28 as seen in FIG. 3. Snap fasteners 48 also include a connecting plate 54 which extends through tape 46 and is secured to interlock part 50 through plate 52. Such a connection allows drape 8 to be fastened to slide member 28 without stitching.

In use, slide members 28 are first snap fitted into track channel part 18 with lock members 36 slidably fitted in channel passageway 19. Drape 8 is then snap fitted onto slide members 28 through snap fasteners 48 to secure the drape to the slide members. The shape of lock members 36 secures the slide members 28 within passageway 19 when snap fasteners 48 are disengaged to allow the drape 8 to be removed for cleaning or adjustment.

It is understood that the above descrption does not limit the invention to the precise details given, but may be modified within the scope of the following claims.

I claim:

1. In a drapery hanger including a drape, track means for slidably supporting said drape, and means slidably connected to said track means and connected to said drape for promoting sliding movement of the drape relative to the track means, the improvement wherein said slide means includes a plurality of slide members fitted within said track means in a snap interlock fashion, said drape including an elongated tape having a plurality of individual snap fasteners affixed thereto, each individual snap fastener detachably connected in a snap fit interlock to a corresponding slide member.

2. The drapery hanger of claim 1 wherein said track means includes a track member having a pair of divergent legs, a pair of opposed lips projecting from said legs to define a slide member receiving channel, each slide member including a substantially triangular lock member which allows the slide member to remain connected to the track member when the drape is disconnected from the slide members.

3. The drapery hanger of claim 1 wherein each slide member includes a base, a generally triangular lock member projecting from said base, said lock member snap fitted within said slide means, said slide member further having a bore defined in its said base for accepting said snap fastener in snap interlock fashion.

4. The drapery hanger of claim 3 wherein said slide member base bore has a peripheral upper lip to secure the snap fastener within the bore.

* * * * *